US005806208A

United States Patent [19]

French

[11] Patent Number: 5,806,208

[45] Date of Patent: Sep. 15, 1998

[54] SHOE WITH MASSAGING FLUID CIRCULATION

[76] Inventor: Michael J. French, 6885 S. Redwood Rd. #2304, West Jordan, Utah 84084

[21] Appl. No.: 763,482

[22] Filed: Dec. 11, 1996

[51] Int. Cl.[6] ..... A43B 13/18

[52] U.S. Cl. ..... 36/28; 36/3 A

[58] Field of Search ..... 36/153, 88, 93, 36/89, 23, 29, 25 R, 30 R, 32 R

[56] References Cited

U.S. PATENT DOCUMENTS

| | | | |
|---|---|---|---|
| 3,685,176 | 8/1972 | Rudy | 36/93 X |
| 3,871,117 | 3/1975 | Richmond et al. | 36/29 X |
| 3,888,242 | 6/1975 | Harris et al. | 128/64 |
| 4,009,528 | 3/1977 | Villari, Jr. et al. | 36/29 X |
| 4,361,969 | 12/1982 | Vermont | 36/88 |
| 4,567,677 | 2/1986 | Zona | 36/43 |
| 5,113,850 | 5/1992 | Larremore et al. | 128/32 |
| 5,195,257 | 3/1993 | Holcomb et al. | 36/28 |
| 5,253,435 | 10/1993 | Auger et al. | 36/88 |
| 5,335,430 | 8/1994 | Fiso et al. | 36/88 |
| 5,343,638 | 9/1994 | Legassie et al. | 36/29 |
| 5,353,525 | 10/1994 | Grim | 36/29 X |
| 5,444,926 | 8/1995 | Allen et al. | 36/93 |

FOREIGN PATENT DOCUMENTS

| | | | |
|---|---|---|---|
| 9110376 | 7/1991 | WIPO | 36/28 |

*Primary Examiner*—B. Dayoan
*Attorney, Agent, or Firm*—Mallinckrodt & Mallinckrodt

[57] ABSTRACT

A shoe providing a massaging effect for a wearer of the shoe includes a sole bladder containing a fluid which can flow within the bladder as a wearer shifts weight in the shoe and at least one flow passage extending from the bladder into a shoe upper adjacent a portion of a wearer's foot and arranged in conjunction with the bladder so that fluid from the bladder will flow through the passage upon at least a particular weight transfer on the bladder. Preferably a flow passage is provided around the heel portion of the shoe and also at locations forwardly of the heel portion of the shoe. The fluid in the bladder is replaceable so that a cooling fluid or a warming fluid can be placed in the bladder. The bladder can also contain recessed portions positioned to relieve pressure on particular areas of a wearer's foot.

22 Claims, 3 Drawing Sheets

SHOE WITH MASSAGING FLUID CIRCULATION

BACKGROUND OF THE INVENTION

1. Field

The invention is in the field of shoes which include fluid circulation therein.

2. State of the Art

Numerous shoes have been proposed to provide shoe soles which include one or more bladders therein containing air or other fluid to provide cushioning to the foot of a wearer of such shoes. The fluid is usually held in the bladder or bladders so that it will flow from the heel area to the toe area when weight is placed on the heel and from the toe area to the heel area when weight is placed on the toe area. There are numerous variations in flow patterns and flow control to adjust the cushioning provided by such soles.

U.S. Pat. No. 4,567,677 shows a bladder for a shoe insole which has a liquid therein which flows back and forth between heel and toe areas, and which has restrictions therein to restrict free flow of fluid. The flow of fluid supposedly provides a massaging action for the foot of the user. However, such action would be limited to the bottom of the foot.

U.S. Pat. No. 5,195,257 shows separate heel and toe plenums filled with air and connected so that air can flow back and forth between the heel and toe plenums. The restriction to flow is greater from heel to toe than from toe to heel. Also, this patent shows plenums to support the area immediately surrounding the metatarsal heads in the forward portion of the foot and surrounding the tuberosity of the calcaneus bony structure in the heel, but with central openings therein to relieve pressure on the bony metatarsal heads themselves and the calcaneus bony structure.

U.S. Pat. No. 5,335,430 shows a sole bladder for providing cushioning for the sole of the foot and a separate and independent upper bladder to improve fit of the shoe upper about the upper portion of the foot.

U.S. Pat. No. 5,444,926 provides a sole bladder under the forefoot area of the sole of a shoe and an upper bladder over the instep portion of the foot. The bladders are connected so that fluid can flow from the sole to the portion of the foot over the instep and back again as a person walks in the shoes. The bladders are suppose to improve fit of the shoe and cushioning for the forefoot and upper instep portion of the foot.

U.S. Pat. No. 5,113,850 discloses a massaging shoe which includes a battery powered vibratory plate in the sole which transmits vibrations to the foot, thereby massaging the foot.

U.S. Pat. No. 3,888,242 shows a hollow boot which surrounds the foot and has a plurality of flexible tips extending into contact with the foot. The boot is inflated and deflated by an air pump connected to the boot by hoses to massage the foot.

SUMMARY OF THE INVENTION

According to the invention, a shoe which provides a massaging effect for the foot as a wearer walks in the shoe, and which can provide cooling or warming of the foot and can be customized to provide pressure relief for pressure spots on the foot, particularly the sole of the foot, includes a fluid filled bladder in the sole of the shoe, preferably substantially coextensive with the bottom of a wearer's foot in the shoe, and fluid flow passages extending from the bladder around a portion of the heel of a foot in the shoe and around a portion of the side of the forward part of a foot in the shoe. The passages are arranged so that fluid flows from the bladder through the passages in a pulsing manner as the wearer walks, runs, or otherwise moves in the shoe to thereby provide a massaging effect to the foot. The passages are preferably collapsible so that they expand, change shape, or otherwise move as the fluid flows through them to provide the massaging action to the foot. Preferably the bladder includes a supply port so the user can change or add fluid to the bladder. For foot cooling, a chilled fluid which maintains its cool temperature over a period of time, or which includes chemicals to provide a cooling reaction, can be inserted into the bladder. For warming, a warm fluid or fluid which includes chemicals to provide a warming reaction, can be inserted into the bladder.

In a preferred form of the invention, a passage extends upwardly from the bladder behind the heel at the back of the shoe and then splits to extend forwardly and downwardly to return to connection with the bladder forwardly of the heel. Thus, when weight is initially placed on the heel while walking or during other activities, fluid from the bladder is forced through the passage extending upwardly behind the heel and flows forwardly through the split passages on either side of the heel in a pulse to massage the sides of the heel. A series of passages extend upwardly from the bladder along the sides of the foot forwardly of the heel portion of the bladder and intermediate the length of the bladder. When weight is placed on the heel during walking or other activities, after the initial pulse of fluid sent upwardly through the passage behind the heel, fluid in the heel portion of the bladder will flow forwardly toward the toe portion of the bladder and during such forward flow, will flow up the passages along the sides of the foot in a pulse to provide massaging action to the sides of the foot as the pulse of fluid flows through such side passages.

Appropriate valving and flow restrictions are provided in the passages and in the bladder to direct flow of fluid. The flow restrictions in the bladder may take the form of walls in the bladder and when the bladder is formed of a plastic material, such walls may be formed by heat sealing the top and bottom of the bladder together where walls or restrictions are desired. In addition, walls or a sealing of the top and bottom of the bladder together at specific pressure points along the sole of a foot can customize the bladder to provide recesses in the bladder where these pressure points are located to relieve pressure on those pressure points.

THE DRAWINGS

The best mode presently contemplated for carrying out the invention is illustrated in the accompanying drawings, in which:

FIG. 1 is a perspective view of the bladder and passages of an embodiment of the invention showing various portions of a shoe in broken lines to indicate how the invention is located in a shoe;

FIG. 2, a vertical section taken on the line 2—2 of FIG. 1;

FIG. 3, a fragmentary bottom plan view of the rear portion of the bladder taken on the line 3—3 of FIG. 2;

FIG. 4, a fragmentary rear elevation of the rear passage of the invention taken on the line 4—4 of FIG. 2 and showing the valve therein;

FIG. 5, a vertical section taken on the line 5—5 of FIG. 2;

FIG. 6, a fragmentary vertical section similar to that of FIG. 2, but showing just the side passages of the invention with valving in the passages;

FIG. 7, a vertical section similar to that of FIG. 2 with arrows indicating fluid flow and weight distribution during a portion of a step;

FIG. 8, a vertical section similar to that of FIG. 7 with arrows indicating fluid flow and weight distribution during a different portion of a step;

FIG. 9, a perspective view similar to that of FIG. 1, but showing a different embodiment of sole restrictions and showing foot pressure relief recesses formed in the bladder; and FIG. 10, a vertical section taken on the line 10—10 of FIG. 9.

DETAILED DESCRIPTION OF THE ILLUSTRATED EMBODIMENT

Figure 1:
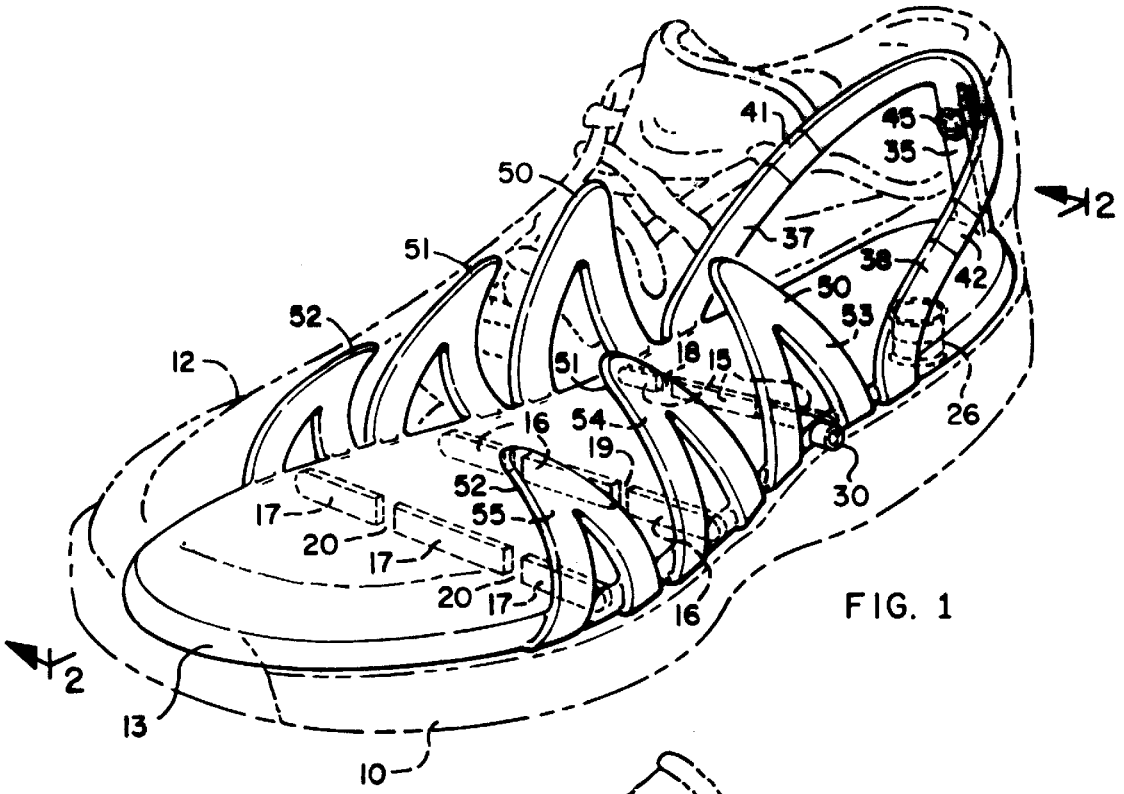
Figure 2:
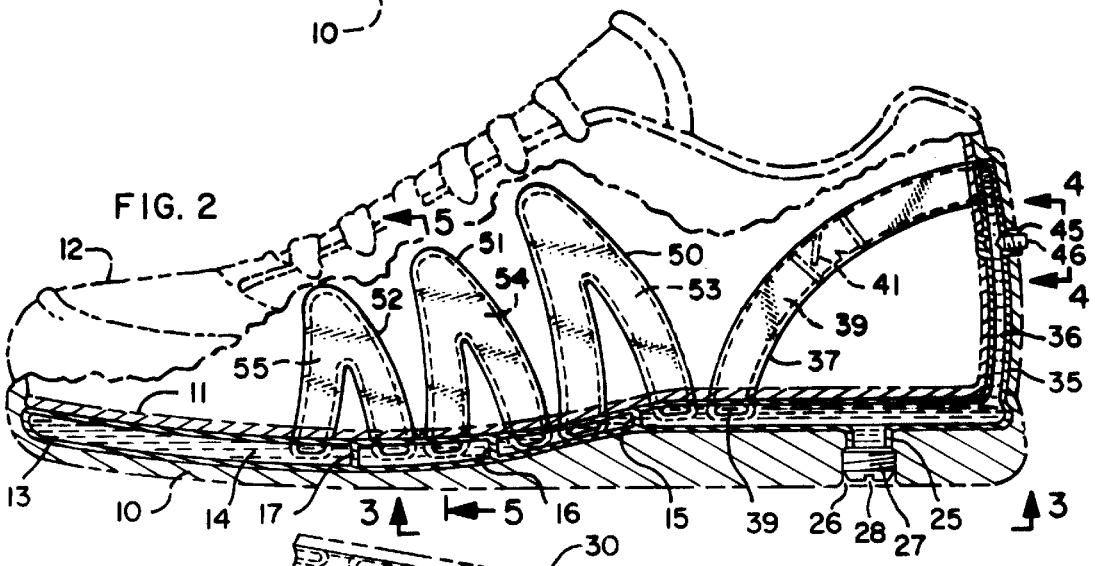

A shoe built in accordance with the invention includes an outer sole 10, FIG. 2, an inner sole 11, and a shoe upper 12. In accordance with the invention, a bladder 13 adapted to contain a fluid 14 is positioned in the shoe between the outer sole 10 and inner sole 11, and preferably is coextensive with the inner sole 11 which is substantially coextensive with a foot of a wearer placed in the shoe. The bladder is made of a somewhat flexible but substantially non-stretchable material, such as a plastic, so that fluid in the bladder will flow between a toe portion of the bladder which underlies the forward portion of a foot in the shoe, from approximately the ball of the foot forward, and a heel portion of the bladder which underlies the heel portion of a foot in the shoe. Thus, as a wearer walks or otherwise moves in the shoe, when weight is placed on the heel of the foot, fluid will flow forwardly in the bladder toward the toe portion thereof, and when weight is placed on the forward portion of the foot, fluid will flow rearwardly in the bladder toward the heel portion thereof. Various restrictions to flow may be included in the bladder to slow flow of fluid from one end to the other upon weight application so that the fluid in the bladder will provide shock absorption and cushioning to the foot of the wearer. For example, the material forming the bladder may be sealed to itself, i.e., the top of the bladder sealed to the bottom of the bladder, at various locations to form walls to provide restrictions to fluid flow or separate walls within the bladder between the top and bottom of the bladder may be provided to provide such restrictions. As shown, flexible walls 15, 16, and 17, FIGS. 1 and 2, may be provided in the bladder to provide partial blockage to fluid flow, the fluid being allowed to flow only through the openings 18, 19, and 20, respectively, in the walls 15, 16, and 17. Fluid may also flow through auxiliary side passages as will be explained. The size and location of the blocks and openings will vary depending upon the desired flow to be achieved and the type of fluid used in the bladder, larger openings being used for more viscous fluids.

A bladder drain port 25, FIG. 2, extends into opening 26 in the heel portion of outer sole 10 and has a threaded stopper 27 screwed into the port to close it. Stopper 27 has cross slots 28 in the outer end thereof so a user can rotate stopper 27 with a screwdriver to remove it to open port 25. Opening of the port 25 allows fluid to drain from the bladder. Fluid can also be added to refill the bladder through drain port 25, and use of port 25 for filling the bladder when the fluid is a liquid that does not have to be pressurized is satisfactory. However, a separate sealing inlet port 30, FIG. 1, may be provided for injecting fluid into bladder 13 and for pressurizing the fluid in bladder 13. Thus, fluid can be injected into the bladder by a pump or syringe that has an end adapted to sealingly penetrate inlet port 30 and to allow the port to seal after removal of the pump or syringe. If desired a port similar to port 30 could be provided through stopper 27.

Figure 4:
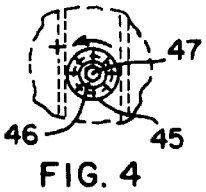
Figure 5:
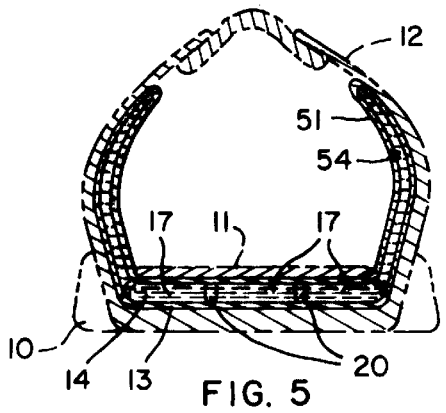

A tube 35 forms a passage 36 extending upwardly from the rearward end of bladder 13 behind the heel of a wearer. Tube 35 splits into tubes 37 and 38 which extend forwardly and downwardly to connection with bladder 13 in the forward part of the heel portion of the bladder as shown or can join forwardly of the heel portion if desired to form passages 39 and 40 which connect to passage 36 and to bladder 13. Thus, fluid can flow from the bladder through passage 36 and passages 39 and 40 back to the bladder. It is currently preferred that flow is from the heel portion of the bladder up through passage 36 and through passages 39 and 40 back to bladder 13. If desired, to ensure this direction of flow, one way valves 41 and 42 may be inserted in passages 39 and 40, respectively. However, flow in the opposite direction or in both directions may also be desired. A heel flow control valve 45 positioned in passage 36 can be adjusted by adjusting valve screw 46 to regulate flow through passages 36, 39, and 40. Valve screw 46 may have an end thereon which makes it easy to turn by a wearer, or, preferably, as shown, has an opening 47, FIG. 4, for accepting a hex key so that the wearer can adjust the valve as desired and it cannot thereafter be easily changed by others.

A series of three side flow tubes 50, 51, and 52 extend upwardly from the bladder on each side of the shoe to extend from the bladder at the bottom of the foot around to the upper side of the foot adjacent the laces for the shoe and then back to the bladder. The side flow tubes 50, 51, and 52 form side flow passages 53, 54, and 55, respectively, which are in flow communication with bladder 13. Thus, fluid from the bladder 13 can flow through side flow passages 53, 54, or 55 from the bladder through the length of the passage concerned back to the bladder.

Figure 6:
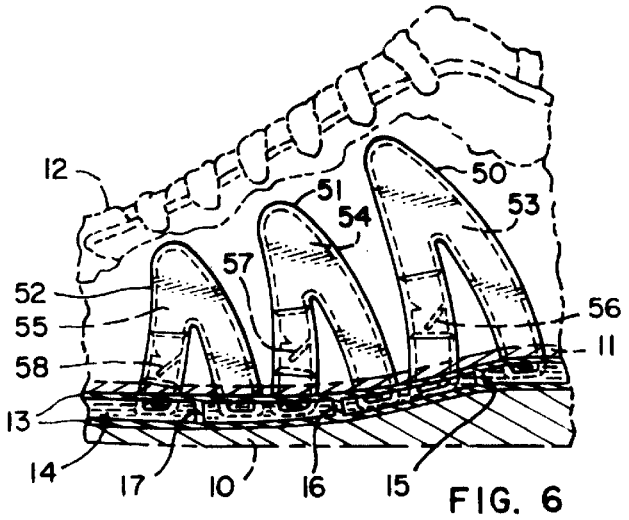

Tubes 35, 37, 38, 50, 51, and 52 are preferably relatively flat flexible tubes which are substantially collapsed when no fluid flows therethrough, and which expand when fluid flows to provide a massaging effect to the feet. If desired, one way valves 56, 57, and 58, FIG. 6, may be provided in passages 53, 54, and 55, respectively.

Figure 7:
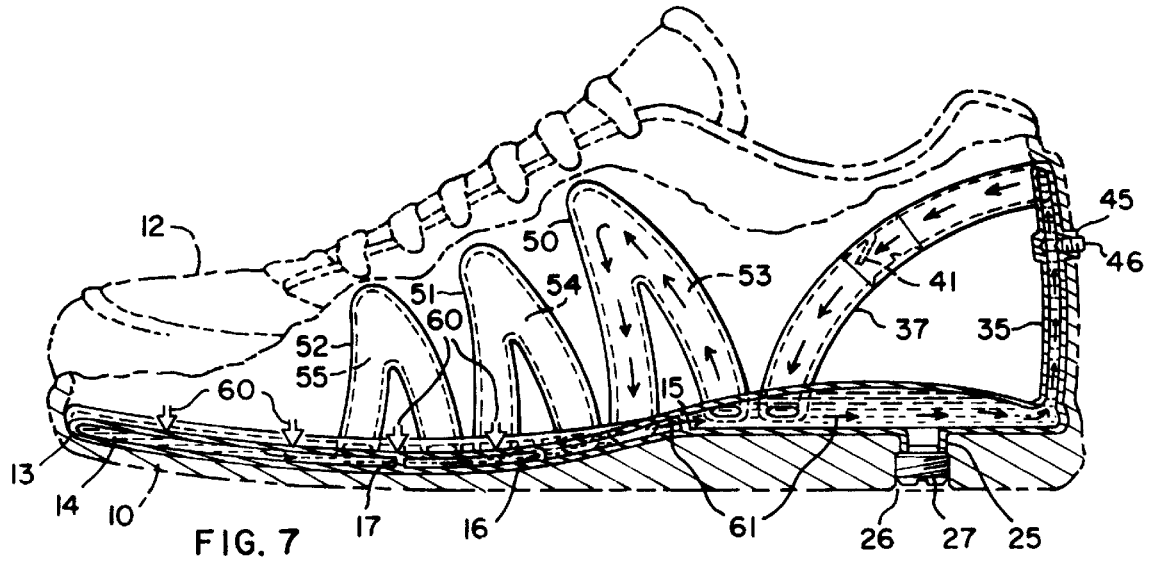

In use, when a wearer of the shoe puts weight on the forward or toe portion of the shoe as shown by arrows 60 in FIG. 7, fluid flows rearwardly in the bladder 13 to the heel portion thereof as shown by arrows 61. The blocks 17, 16, and 15 create resistance to fluid flow and slow it down so that the bladder provides cushioning for the forward portion of the foot. Fluid may also flow through passages 55, 54, and 53 depending upon the valving provided and the restrictions provided. As the fluid flows into the heel portion of the bladder and the bladder cannot expand significantly, although it will bulge, fluid will start to flow up heel passage 36 into passages 37 and 38. The amount of flow through passage 36 can be set by valve 45. Fluid may also start to flow from the heel portion into passage 53.

Figure 8:
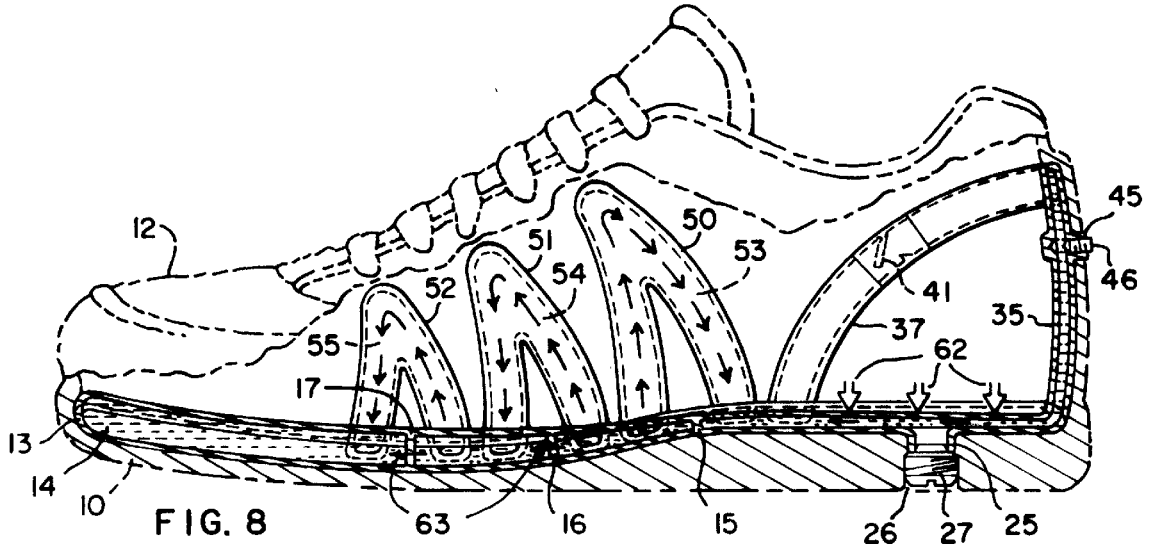

As the wearer shifts weight to put pressure on the heel portion of the bladder as shown by arrows 62 in FIG. 8, the fluid will continue to flow up heel passage 36 substantially in a pulse and through passages 39 and 40 to return to bladder 13 and fluid will flow through the bladder to the toe portion thereof as shown by arrows 63. As flow of fluid forwardly is restricted by blocks 15, 16, and 17, fluid will flow not only through openings 18, 19, and 20, but also through passages 53, 54, and 55, thereby pulsing through tubes 50, 51, and 52 to provide a massaging action to the side and top of the wearer's foot and to collect in the toe area of the bladder. As weight shifts again to the toe area of the foot, the fluid begins to flow back to the heel area to start the cycle again.

With one way valves in the tubes, the flow will be only in the direction allowed by the valves. If such valves are not present, flow can be in either direction. Since the heel generally exerts more pressure on the heel portion of the bladder when the heel of the shoe strikes a surface during walking or running than does the toe portion of the foot on the toe portion of the bladder as the step follows through, flow from the heel to the toe will generally cause flow through the side tubes 50, 51, and 52. Further, the placement of blocks or walls 15, 16, and 17 are such as to encourage flow through such side tubes. With one way valves to allow only forward flow through side tubes 50, 51, and 52, flow from toe to heel is more restricted than flow from heel to toe. If one way valves are provided oppositely in side tubes 50, 51, and 52, to allow only toe to heel flow through the tubes, flow from heel to toe is more restricted than flow from toe to heel. Equal restriction is provided with no one way valves. Valving, blockages (walls), and openings can be arranged as desired to create a desired effect for the shoe. It should also be noted that as fluid flows from toe to heel to cause the heel area to bulge, such bulging provides lift and rebound to a wearer's heel.

With the fluid in the bladder of the shoe of the invention replaceable, the fluid used at any particular time can be selected for special conditions or special results. Where the shoe is used for sports activities on hot surfaces in hot weather, it may be desirable to use a fluid to provide cooling to the shoe and the foot of a wearer of the shoe. In such instance, a fluid that tends to retain its temperature may be cooled in a refrigerator or freezer prior to being placed in the bladder so that the fluid in the bladder will remain cool and cool a foot in the shoe for an extended period of time, as for example, of an hour or several hours. Such fluids may be saline solution or a fluid similar to those used in freezer packs. Alternately, a fluid which contains reaction chemicals which react endothermically to cool the fluid can be placed in the bladder so that the reaction takes place over an extended time, such as several hours or more, to cool the shoe. Similarly, for cold weather wear, a warm fluid that tends to retain its heat can be used to keep a foot warm in cold weather or a fluid which has reaction chemicals which react exothermically to heat the fluid over an extended period of time may be used. A calcium and water solution provides an exothermic reaction which heats the fluid and the heat producing reaction continues for an extended period of time. With material in the bladder having high heat capacity to retain the heat, the shoe, or the bladder in the form of an insert, could be placed in a microwave oven to heat the material.

While the embodiments shown illustrate specific flow passage locations, it should be realized that various layouts of flow passages in the shoe could be used to provide desired massaging action and heating and cooling action to a foot. Further, the invention can be used with various styles and types of shoes or boots. In some cases, where the type of shoe allows, the passages may extend over the foot rather than merely to the laces and tongue as in the illustrated embodiments.

Figure 9:
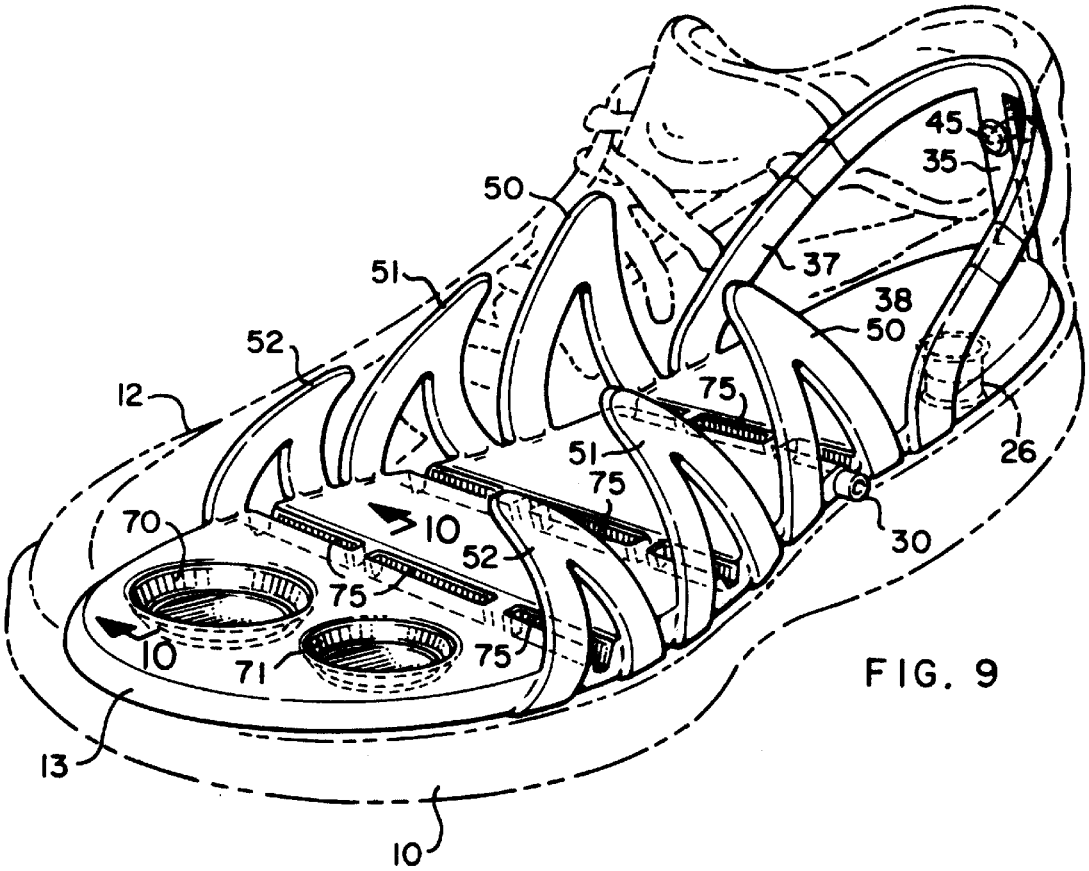
Figure 10:
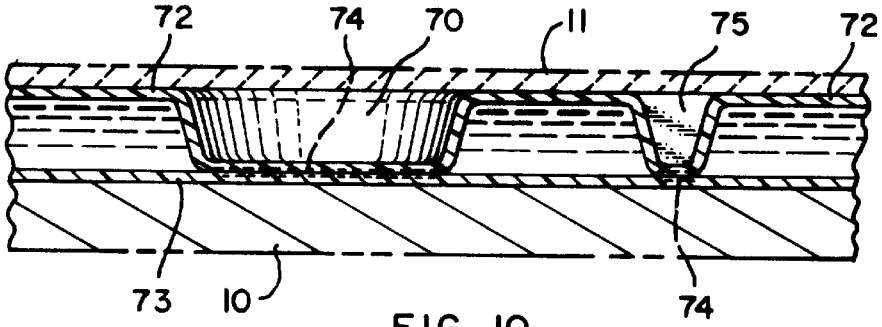

A further embodiment of the invention specifically adapted for use with people having problem areas on the soles or bottoms of their feet, such as unnatural bones, corns, warts, etc., which hurt when weight is placed on them as weight is placed on a foot, is shown in FIGS. 9 and 10. In such embodiment, the bladder includes recessed areas 70 and 71 positioned as desired in the bladder to underlay a pressure sensitive portion of a wearer's foot. The recesses provide pressure relief areas in the bladder isolated from the fluid in the bladder and relieve pressure on the portion of a wearer's foot immediately above a recess because the foot is supported by the bladder surrounding the recess and not by the recess.

As shown in FIGS. 9 and 10, the recesses may be formed by attaching or sealing, such as by heat sealing in plastic materials, the top wall 62 of the bladder to the bottom wall 63 of the bladder as at 64. Also, as shown in FIGS. 9 and 10, the walls restricting flow of fluid in the bladder may also be similarly formed.

Figure 3:
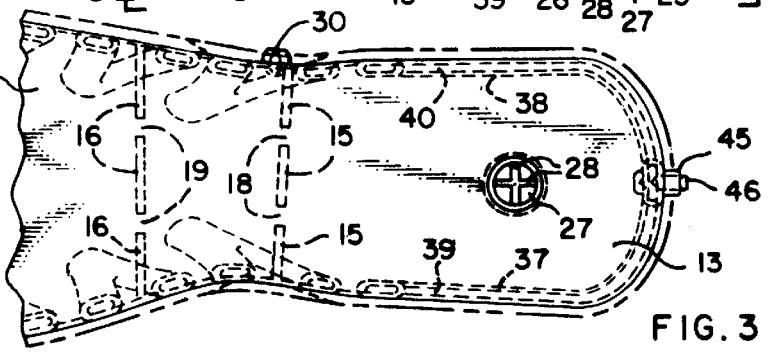

While such recesses can be formed in areas of the bladder where a wearer is most likely to have a pressure point, and sold with such recesses preformed, with plastic materials, a wearer, or a seller of the bladders, either as a built in part of a shoe, or as an insert for a shoe, can custom locate and form the recesses to match a particular wearer's pressure points. Such recesses can be formed by a heated tool which can press the top wall 62 and bottom wall 63 of the bladder together and provide sufficient heat to seal the top wall 62 to the bottom wall 63 to provide a recess of desired size in a desired location or locations. If the recesses are factory formed, they can be formed with walls similar to those shown in FIGS. 1–3 and could be partially filled with fluid or with a foam material to provide some cushioning but still function to relieve pressure.

While the invention has been illustrated and described as being built into a shoe or as an integral part thereof, and this is presently preferred to keep the tubing in place while a user puts the shoe on or takes it off, the invention could be provided as an insert for shoes with the bladder and tubing having adhesive to be secured to the inside of a shoe, or with a lining for the insert, preferably a shape retaining lining secured to the bladder to hold the tubing in place so that the foot can be easily inserted into the lining.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A shoe which provides a massaging effect due to fluid flow in the shoe during use of the shoe, comprising:

a shoe sole;

a shoe upper;

a bladder in the shoe sole extending from a heel portion of the sole to a toe portion of the sole;

a reaction fluid within the bladder wherein the reaction in the fluid adjusts the temperature of the fluid;

means for replacing the reaction fluid within the bladder;

fluid flow means extending from the bladder into the shoe upper to be adjacent a portion of the foot in the shoe upper and in fluid flow communication with the bladder;

wherein fluid will flow from the bladder into and through the fluid flow means as weight is shifted in the shoe on the bladder to stimulate and massage at least the portion of the foot of a wearer of the shoe adjacent the fluid flow means.

2. A shoe according to claim 1, wherein the reaction fluid within the bladder is a fluid which gives off heat.

3. A shoe according to claim 1, wherein the reaction fluid within the bladder is a cooling fluid.

4. A shoe which provides a massaging effect due to fluid flow in the shoe during use of the shoe, comprising:

a shoe sole;

a shoe upper;

a bladder in the shoe sole extending from a heel portion of the sole to a toe portion of the sole;

fluid within the bladder;

a heel fluid flow means including a flow passage extending from the bladder upwardly along a rearmost portion of the heel of the shoe upper and branching into two heel side flow passages which extend around the heel and back to the bladder;

wherein fluid will flow from the bladder into and through the heel fluid flow means as weight is shifted in the shoe on the bladder to stimulate and massage the heel of the foot of a wearer of the shoe adjacent the heel fluid flow means.

5. A shoe according to claim 4, additionally including flow regulation means in the heel fluid flow means.

6. A shoe according to claim 5, wherein the heel fluid flow means includes one way flow control means in the heel fluid flow means to allow flow through the heel fluid flow means in only one direction.

7. A shoe according to claim 4, additionally including at least one side fluid flow means extending along at least a portion of the side of the shoe upper.

8. A shoe according to claim 7, wherein the side fluid flow means is a flow passage extending upwardly from the bladder at a first position forwardly of the heel portion of the sole and returning to the bladder at a second position also forwardly of the heel portion of the sole and spaced from the first position.

9. A shoe according to claim 8, wherein the bladder includes flow restricting means therein between the first position and second position to encourage flow through the side fluid flow means when fluid flows in the bladder.

10. A shoe according to claim 9, including a plurality of side fluid flow means.

11. A shoe according to claim 10, wherein the bladder includes means for replacing the fluid within the bladder.

12. A shoe according to claim 4, wherein the heel fluid flow means is a flexible tube which has a substantially collapsed configuration with no fluid flowing therethrough and expands when fluid flows therethrough.

13. A shoe according to claim 4, wherein the fluid is a high heat capacity fluid whose temperature can be adjusted prior to use of the shoe and the fluid will tend to maintain its adjusted temperature for an extended period of use after adjustment.

14. A shoe which provides a massaging effect due to fluid flow in the shoe during use of the shoe, comprising:

a shoe sole;

a shoe upper;

a bladder in the shoe sole extending from a heel portion of the sole to a toe portion of the sole;

fluid within the bladder;

a side fluid flow means including a side fluid flow passage extending upwardly from the bladder at a first position forwardly of the heel portion of the sole and returning to the bladder at a second position also forwardly of the heel portion of the sole and spaced from the first position;

wherein fluid will flow from the bladder into and through the side fluid flow means as weight is shifted in the shoe on the bladder to stimulate and massage the side of the foot of a wearer of the shoe adjacent the side fluid flow means.

15. A shoe according to claim 14, wherein the bladder includes flow restricting means therein between the first position and second position to encourage flow through the side fluid flow means when fluid flows in the bladder.

16. A shoe according to claim 15, including a plurality of side fluid flow means.

17. A shoe according to claim 14, additionally including flow regulation means in the side fluid flow means.

18. A shoe according to claim 17, wherein the side fluid flow means includes one way flow control means in the side fluid flow means to allow flow through the side fluid flow means in only one direction.

19. A shoe according to claim 14, wherein the side fluid flow means are flexible tubes which have a substantially collapsed configuration with no fluid flowing therethrough and expands when fluid flows therethrough.

20. A shoe according to claim 14, wherein the fluid is a high heat capacity fluid whose temperature can be adjusted prior to use of the shoe and the fluid will tend to maintain its adjusted temperature for an extended period of use after adjustment.

21. A shoe which provides a massaging effect due to fluid flow in the shoe during use of the shoe, comprising:

a shoe sole;

a shoe upper;

a bladder in the shoe sole extending from a heel portion of the sole to a toe portion of the sole;

fluid within the bladder, the bladder including pressure relief areas isolated from fluid within the bladder to provide pressure relief for portions of a wearer's foot needing such relief;

fluid flow means extending from the bladder into the shoe upper to be adjacent a portion of the foot in the shoe upper and in fluid flow communication with the bladder;

wherein fluid will flow from the bladder into and through the fluid flow means as weight is shifted in the shoe on the bladder to stimulate and massage at least the portion of the foot of a wearer of the shoe adjacent the fluid flow means.

22. An insert for a shoe to provide a massaging effect to a foot placed in the shoe, comprising:

a bladder for insertion into a shoe to fit substantially coextensively under a foot placed in the shoe and having a heel portion and a toe portion;

fluid within the bladder;

side fluid flow means in fluid flow communication with the bladder including a side fluid flow passage extending upwardly from the bladder at a first position forwardly of the heel portion of the bladder and returning to the bladder at a second position also forwardly of the heel portion of the bladder and spaced from the first position, said side fluid flow means adapted to fit between the foot placed in the shoe and a shoe upper;

wherein fluid will flow from the bladder into and through the side fluid flow means as weight is shifted in the shoe on the bladder to stimulate and massage at least the portion of the foot of a wearer of the shoe adjacent the side fluid flow means.

* * * * *